United States Patent [19]

Nishida

[11] Patent Number: 4,743,213

[45] Date of Patent: May 10, 1988

[54] SELF-HALT DEVICE FOR WATER CRAFT

[75] Inventor: Hiroshi Nishida, Miki, Japan

[73] Assignee: Kawasaki Jukogyo Kabushiki Kaisha, Kobe, Japan

[21] Appl. No.: 20,074

[22] Filed: Feb. 27, 1987

[30] Foreign Application Priority Data

Mar. 28, 1986 [JP] Japan ..... 61-70550

[51] Int. Cl.[4] ..... B63H 11/00

[52] U.S. Cl. ..... 440/1; 440/38; 114/270; 180/273

[58] Field of Search ..... 114/270; 440/38, 1, 440/2; 180/290, 273, 272

[56] References Cited

U.S. PATENT DOCUMENTS 3,721,208 3/1973 Lampert et al. ..... 440/38

3,807,343 4/1974 Peebles ..... 440/1

*Primary Examiner*—Joseph F. Peters, Jr.

*Assistant Examiner*—Edwin L. Swinehart

[57] ABSTRACT

A self-halt device for water-jet, power-driven water craft is disclosed, which includes a duct connected at a forward end thereof to the atmosphere and, at its opposite end, to a water passage defined in the rear bottom of the water craft in which a propeller is connected to an engine through a propeller shaft. A valve is installed in the duct, which closes or opens the duct in response to sensing the weight of a driver properly sitting in or standing on a driver seat mounted on top of the water craft deck. With the valve in its operating position where the duct is closed, the engine rotates the propeller in the water passage filled with water which is discharged in a jet from the stern. When the pressure is removed from the driver seat, as when the driver was inadvertently displaced from board, the valve is actuated to open the duct permitting atmospheric air into the water passage, so that engine rotates the propeller on air. Thus, the water craft is brought to a halt, without stopping the engine, within easy reach of the displaced user who can swim over and recapture the water craft.

12 Claims, 4 Drawing Sheets

SELF-HALT DEVICE FOR WATER CRAFT

BACKGROUND OF THE INVENTION (1) Field of the Invention

This invention relates in general to a water-jet, power-driven water craft and, in more particular, to a self-halt device for such water craft.

(2) Description of the Invention

In the past, various types of water-jet, power-driven water craft with automatic engine control devices have been developed and used in which, should the user be inadvertently displaced therefrom during cruising, the engine is automatically stopped or rendered to idling state allowing the water craft to stand floating or gyrating on the spot within such a distance that the displaced user can swim over and recapture it. One such an example is disclosed in published Japanese patent application No. 54-30197 in which the handle bar of the water craft is normally urged to turn in one direction about its axis by a spring to a gyration position where the steering nozzle for the jet discharge is dislocated to cause the vehicle to gyrate. In operation, the user keeps the handle bar turned to a cruising position against the spring force, with the handle-bar grip held turned to a desired speed position against resilient force acting to rotate the grip back to a position where the engine is set to idling. With this arrangement, should the driver be inadvertently thrown off board, the handle bar will automatically spring back and the grip is released to its normal position thereby causing the vehicle to gyrate at low idling speed.

However, those water crafts with conventional engine control devices have been found to pose problems. For example, with ones with the engine stopper, restarting the engine, after the displaced user has recaptured the water craft, demands a vast amount of electricity consumption, in the case of a cell motor starter, or human labor, in the case of a recoil type starter. With water crafts equipped with the system that, upon the user being off aboard, permits cooling water into the exhaust line, the serious disadvantage is that water can flood the engine through the exhaust line so that restarting the engine becomes considerably difficult.

In addition, with those having the device that causes the water craft to gyrate on the spot at low speed when the user is inadvertently displaced therefrom, the spring used to urge the handle bar constantly in one direction is under stress during operation when the driver holes the handle bar turned to operating positions against the action of the spring. Thus, springs in those water crafts are liable to breakdown due to fatigue from stress as a result of prolonged operation. The present invention has been proposed to overcome the above-mentioned operational disadvantages of prior art self-halt devices.

SUMMARY OF THE INVENTION

It is, therefore, a primary object of the present invention to provide a self-halt device for water craft which can automatically halt the water craft, without stopping the engine, when the user is inadvertently displaced therefrom.

The above and other objects, features and advantages of the present invention are achieved by the system comprising a duct that opens at one end thereof to the atmosphere and, at its opposite end, connects to a water passage defined in the rear bottom of the water craft, through which water is sucked from an opening formed at its forward end by a propeller, which is installed in the passage, which discharges the water in a jet at the stern to propel the water craft. The duct is joined to the passage at a point upstream of the propeller and carries therein a valve which selectively takes one of two positions, the first where it closes the duct and the second where it opens it permitting atmospheric air into the passage so that the water craft is eventually caused to halt, with the propeller rotating on air. The valve is fixed to a driver seat that is resiliently supported on a level slightly way above the plane of the deck in which the weight of a user exerts pressure on the seat causing the valve to close the duct. If the user is inadvertently displaced from the vehicle, the seat moves up by the action of the spring members causing the valve to open the duct. Furthermore, engine speed may be controlled by a conventional handle-bar grip, which may be normally urged by spring force to a position where the engine is rendered to idling state. In operation, the grip is turned to speed positions as required. Thus, when the driver is thrown off board, the released grip springs back to its home position rendering the engine to idle.

In another embodiment, the duct may be connected to an exhaust line, instead of opening to the atmosphere, in such a manner that permits exhaust gases to enter the water passage upon the pressure on the seat being removed to cause the valve to open the duct.

This arrangement also enables a driver to bring his water craft to a halt, without stopping the engine, simply by shifting his weight in the seat or rising into a standing position, with the grip being released.

DETAILED DESCRIPTION OF PREFERRED EMBODIMENTS

The preferred embodiments of the present invention will be described in more detail in conjunction with the accompanying drawings.

Figure 1:
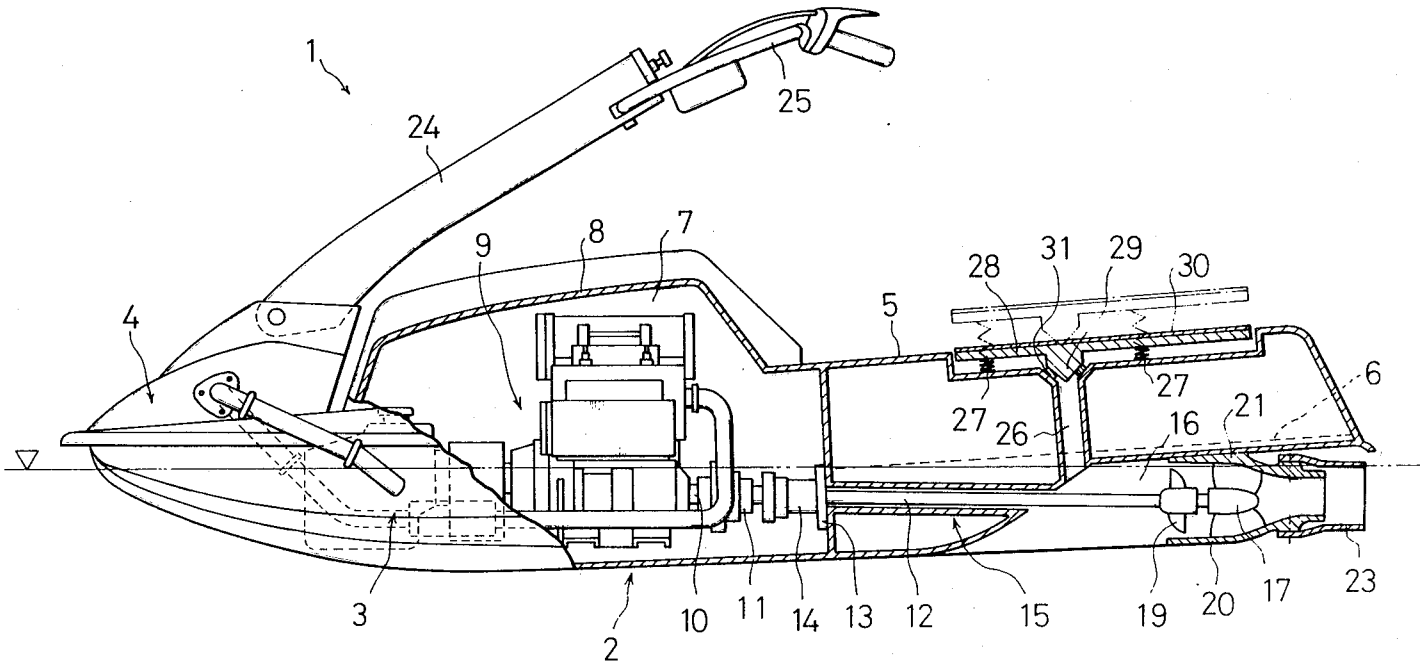
FIG. 1 is a water craft of the type in which the user drives in a sitting position, constructed according to a preferred embodiment of the present invention.

Referring first to FIG. 1, which illustrates a water-jet, power-driven water craft of the type in which the user drives in a sitting position, the water craft 1 consists of a body 2 composed of a hull 3 made of fiberglass reinforced plastic (FRP) and a deck 4 portion welded to the hull 3 into a flange encircling the body 2. The deck 4 is formed into a central bench 5 and a pair of stepped floors 6 on both sides of the bench in its rear half. In the front half of the deck 4 is detachably mounted a hood 8 to close an engine compartment 7 in which an engine 9 is housed. The engine 9 has a crankshaft 10 which transmits torque developed by the engine 9 to a propeller shaft 12 that is connected at a front end thereof to the output end of the crankshaft 10 through a coupling 11. The propeller shaft 12 is supported adjacent to the crankshaft 10 by a bearing 14 secured in a stationary bulkhead 13 installed in the front half of the body 2. Also, the propeller shaft 12 extends through a shaft cover 15 that encloses a front portion of the propeller shaft 12 into a water passage 16 defined in the rear bottom of the body 2 where the propeller shaft 12 is rotatably supported at its rear end by a bearing 17. A propeller 19 is secured to the propeller shaft 12 adjacent to the bearing 17 and is enclosed in a propeller casing 20.

A stator 21 is mounted in the water passage 16, which is made integral with the bearing 17 and fixdedly secured to the propeller casing 20. A steering nozzle 23 is pivotally mounted at a rear end of the water passage 16 for pivotal motion above a vertical axis and is operatively connected through a steering column 24 to a handle bar 25 which is manipulated to move the steering nozzle 23 which in turn changes the direction of the jet through the water passage 16 to steer the water craft 1.

A duct 26 is provided mounted in the bench 5, which, at an upper end thereof, opens to the atmosphere and, at its lower end, is connected to the water passage 16 at a point upstream of the propeller 19. A platform 28 is mounted on top of the bench 5 to constitute a driver seat for the driver of the water craft 1. The platform 28 is supported on spring members 27 on a level slightly way above the plane of the deck 4 in such a manner that it moves resiliently up and down. A cushion 30 may overlies the platform 28. A valve 29 is secured to the underside of the platform 28 at a location that matches the upper opening of the duct 26 so that, when the platform 28 is pressed down against the top surface of the bench 5, the valve 29 closes the duct 26. On the other hand, if no pressure is exerted on the top surface of the platform 28, the force of the spring members 27 keeps it off from the bench thereby holding the valve 29 away from the opening of the duct 26. Needless to say, the combined force of the spring members 27 is small enough to be compressed by the average user's body weight but large enough to withstand the weight of the platform 28 with its cushion 30 without compression.

With the above-mentioned arrangement, when a user sits correctly in the platform 28 for operation, it is pressed down against the force of the spring members 27 into its lower position, depicted in solid line in Fig. 1, causing the valve 29 to close the duct 26 with a valve seat 31 formed about the periphery of the duct 26 opening. With the duct 26 closed in this way, the user starts the engine 9 which in turn drives the propeller 19 in the water passage 16 now filled with water as the duct 26 is fully closed. Thus, the user is allowed to switch to speed positions as required by turning the handle-bar grip and turn left or right by manipulating the handle bar 25 which in turn controls the steering nozzle 23.

Should the user be inadvertently displaced from the water craft 1, the released grip of the handle bar 25 turns back automatically to its idling position by spring force rendering the engine 9 idling. Simultaneously, removal of the driver's weight on the platform 28 causes it to float up by the action of the spring members 27 causing the valve 29 to leave the valve seat 31 opening the duct 29. Thus, atmospheric air is permitted into the water passage 16 allowing the propeller 19 to rotate on air. In this way, the water craft 1 comes to a halt, with its engine 19 idling, within an easy reach of the displaced user, which can swim over and recapture the water craft.

Furthermore, the arrangement enables a user to stop his water craft simply by shifting his sitting position in the platform 28 or rising into a standing position in such a manner that tilts the platform 28 to an angle greater enough to cause the valve 29 to open the duct 26.

Figure 2:
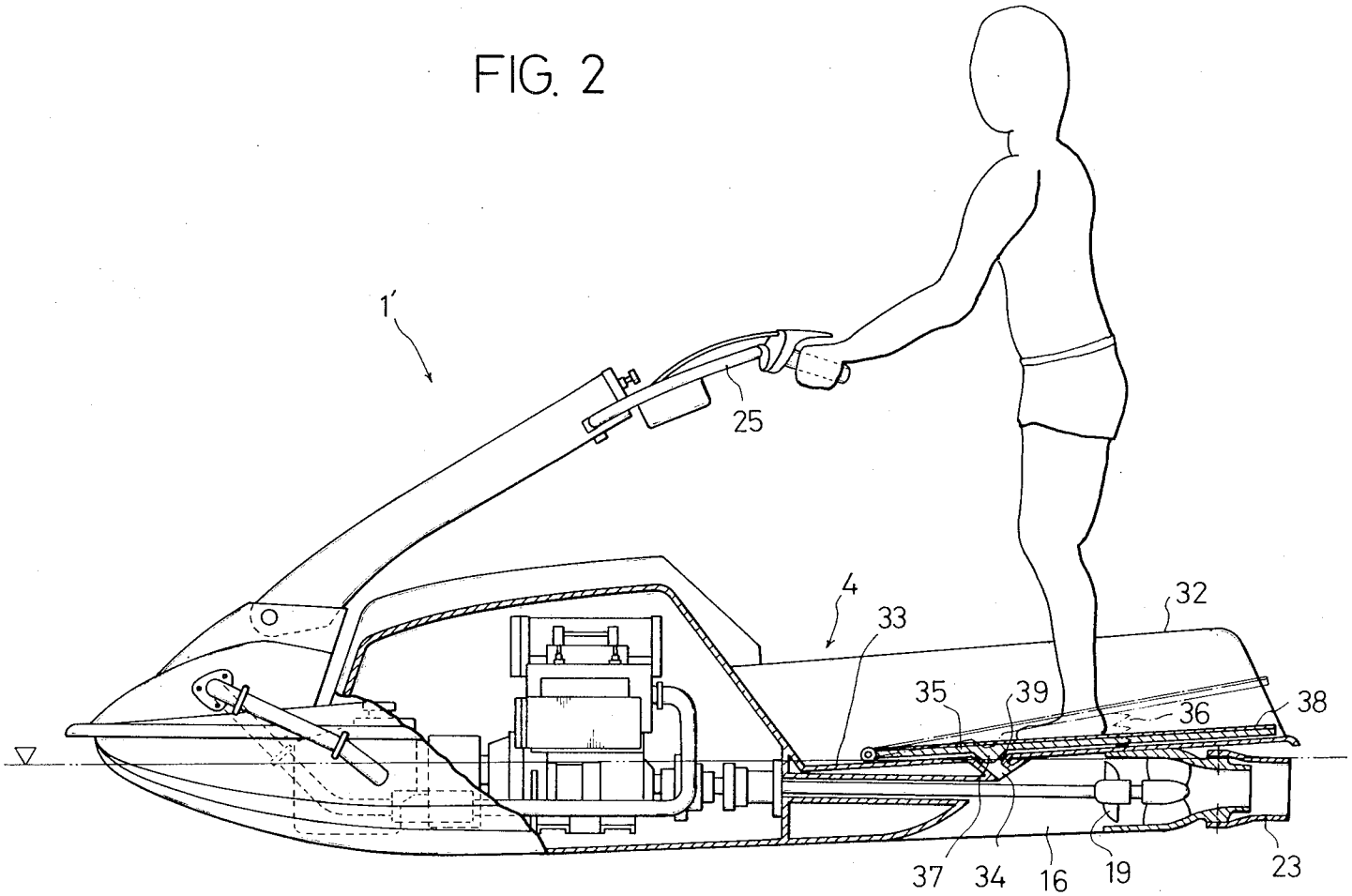
FIG. 2 is a side cross-sectional view of a similar water craft of the type in which the user drives in a standing position, constructed according to another preferred embodiment of this invention.

FIG. 2 illustrates a water craft of the type in which the drivers operates in a standing position, built according to a second embodiment of the present invention, in which like parts are designated by like reference numerals. The water craft 1' has a rear part of its deck 4 into a parallel pair of fins 32 that hems in on a stepped central floor 33. A duct 34, similar in function to the one 26 of the previous embodiment, is defined, which opens in the central floor 33 at an upper end thereof and, at its lower end, connects to the water passage 16 at a point upstream of the propeller 19. A platform 35 is mounted on top of the central floor 33, supported on spring members 36, and is equipped with a valve 37 that is secured to the backside of the platform. The valve 37 is inserted into the duct 34 and, when the platform 35 is pressed down against the central floor 33 as by the weight of a user standing correctly on the platform, the valve 37 moves down in the duct 34 into contact with a valve seat 39 secured there closing the duct 34. Thus, the vehicle 1' can be operated. The total force of the spring members 36 is determined with respect to the weight of the average user same as with the previous embodiment.

Should the user be inadvertently displaced from the water craft 1', the water craft 1' is automatically halted due to the presence of atmospheric air introduced through the duct 34, with the engine 19 being rendered idling, in substantially the same manner as decribed in connection with the first embodiment.

In the previous two embodiments explained in connection with FIGS. 1 and 2, respectively, the valve 29, 37 is directly controlled by physical movement of the platform 28, 35 in response to the user's weight. In an alternative version, an electromagnetic valve may supercede the valve 29, 37, which closes or opens the duct 26, 34 in response to the signal from a sensor installed in the bench 5 or in the central floor 33. The sensor switch in turn responses to the weight of a user properly sitting in or standing on the platform 28, 35. In a second version, an electromagnetic valve may opens or close the duct 26, 34 in response to the signal from a microswitch which in turn is controlled by the position of the handle bar grip. For example, the microswitch sets the electromagnetic valve to a position where the valve opens the duct 26, 34 in response to the grip being rotated back, as when the grip is released, to its home position where the engine is rendered idling.

Figure 3:
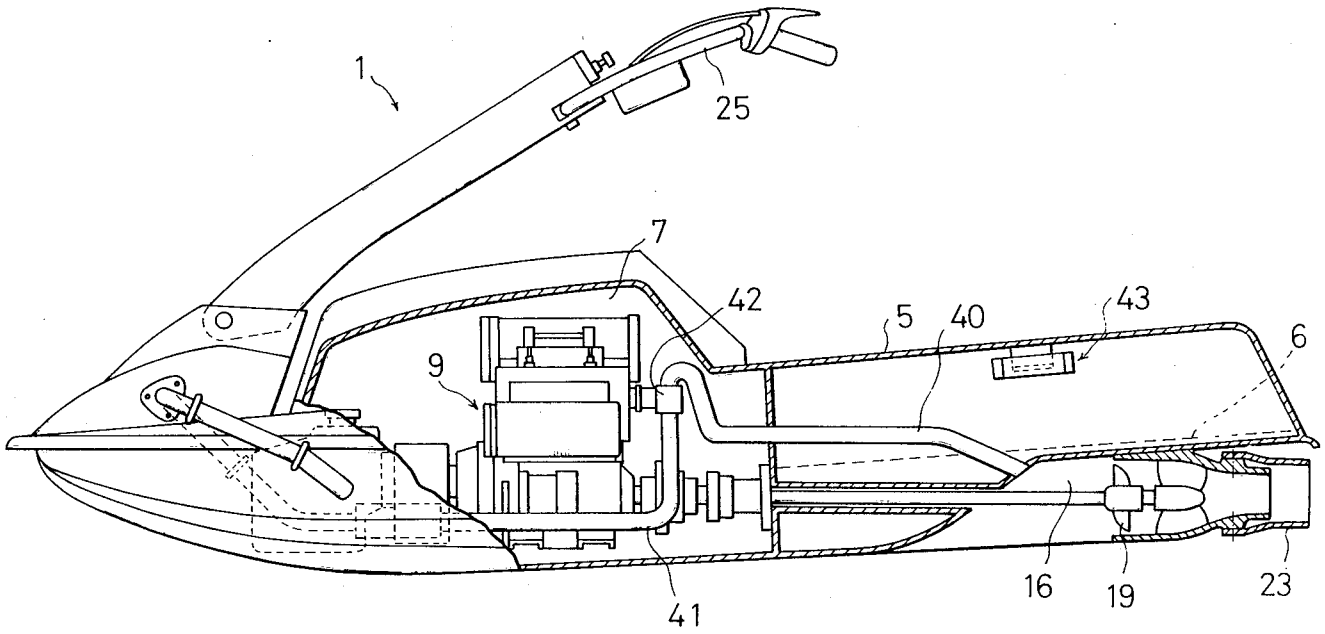
FIG. 3 is a side cross-sectional view of a sitting-in type water craft according to a third embodiment of this invention.

A third embodiment of the present invention will be described with respect to FIG. 3 which illustrates a water craft of the same type as the one in FIG. 1. In the description which follows, like parts are designated by a like reference numerals. The water craft includes a duct 40 which is connected at a forward end thereof to an exhaust line 40 adjacent to the exhaust pipe of the engine 9 through a three-way valve 42. The exhaust line 41 opens at a forward end thereof to the atmosphere. Also, the duct 40 has its opposite end joined in fluid communication with the water passage 16 at a point upstream of the propeller 19. A sensor 43 is operatively connected to the three-way valve 42 and is installed in the bench 5 in such a manner that is operated to control the three-way valve 42 in response to sensing the pressure of a user properly sitting in the bench 5. The three-way valve 42 may, under the control of the sensor 43, one of the two positions. In the first position, the engine 9 exhaust pipe is connected only to the exhaust line 40 allowing exhaust gases to escape into the atmosphere. With the three-way valve 42 in the second position, the engine 9 exhaust pipe, now disconnected from the exhaust line 40, is brought into communication with the exhaust line 41 thereby permitting exhaust gases into the water passage 16.

With the above-explained arrangement, when a user gets aboard on the water craft 1 and seats himself properly in the bench 5, his weight on its causes the sensor 43 to set the three-way valve 42 to the aforesaid first position. Thus, when the user starts the engine 9 and turns the grip of the handle bar 25 against spring force to a desired speed position, the engine 9 drives the propeller 19 in the water passage 16 filled with water which is discharged in a jet through the steering nozzle 23 as the propeller 19 increases its speed. Furthermore, manipulating the handle bar 25 enables the water craft 1 to turn left or right by wagging the steering nozzle 23. On the other hand, removal of the user's weight from the bench 5, as when he was inadvertently displaced from board, causes the sensor 43 to set the three-way valve 42 to the aforesaid second position. Thus, exhaust gases permitted into the water passage 16 so that, since the engine 9 runs the propeller 19 in gas-filled space, the water craft 1 comes to lose motion. In addition, the now released grip automatically rotates back to its normal position rendering the engine 9 idling.

As with the first embodiment described above, a user may utilize the self-halt device to halt the water craft 1 without stopping the engine 9 by moving his sitting position or rising into a standing position in such a manner that removes the pressure from the sensor 43.

Figure 4:
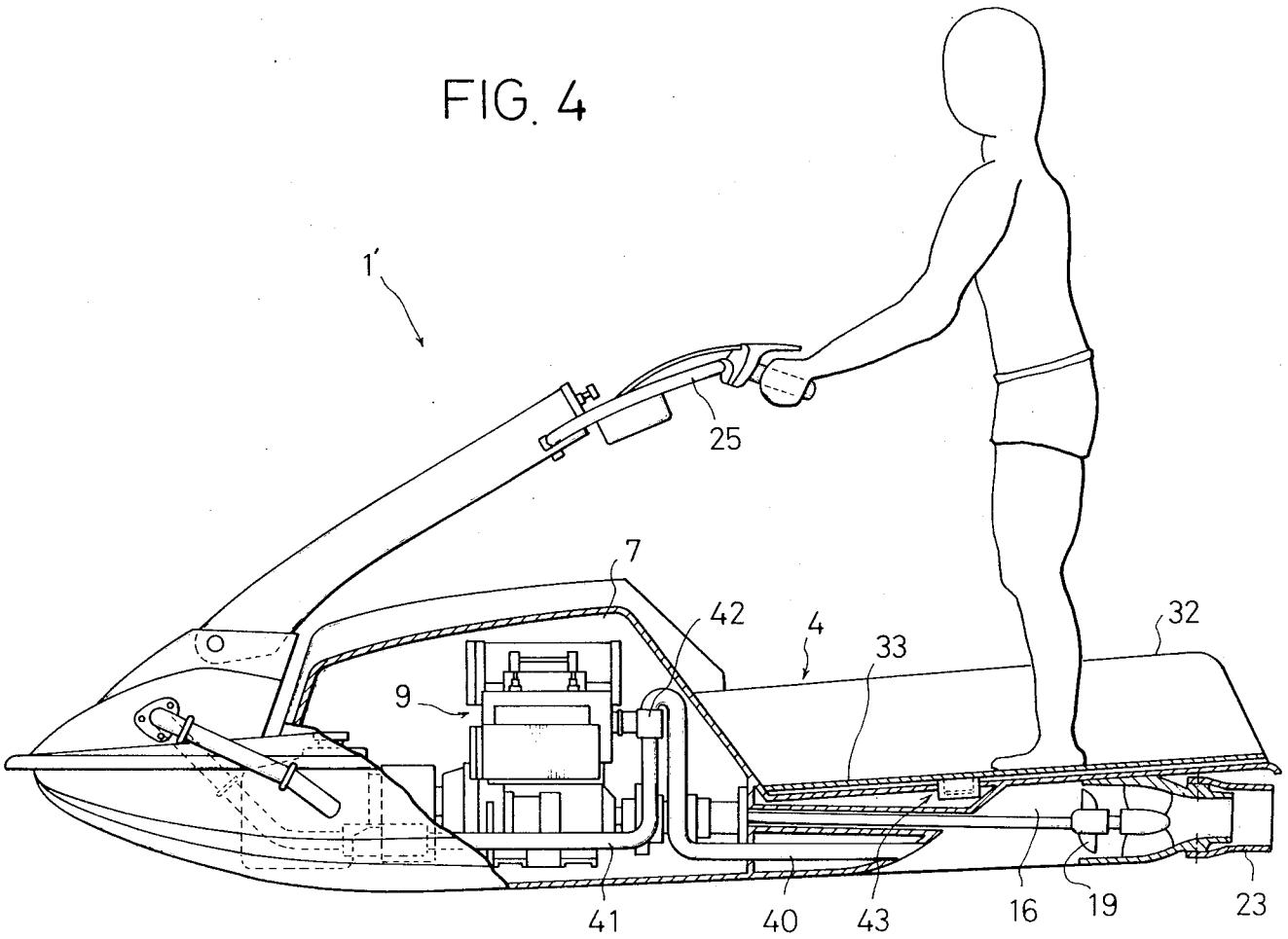
FIG. 4 is a side cross-sectional view of a standing-on type water craft according to a fourth embodiment of this invention.

Referring finally to FIG. 4, which illustrates a water craft of the same type as the one shown in FIG. 2, a fourth embodiment of the present invention will be described. Similarly, like parts are indicated by like reference numerals. This embodiment is similar to the third embodiment except in two main points. First, the duct 40 connected at its forward end to the engine exhaust pipe through the three-way valve 42 is laid to extend below the propeller shaft 12 to connect at its rear end to a forward end portion of the water passage 16. Second, the sensor 43 is installed in the central floor 33 where a user stands to drive the water craft 1'. The operation of the self-halt system is substantially similar to the third embodiment and is not described for brevity's sake.

In the above embodiments described in connection with FIGS. 3 and 4, the three-way valve 42 may be operatively connected to a sensor 43 capable of detecting the weight of a user on the bench 5 to send information to the three-way valve. When the absence of such weight on the bench 5 is detected, as when the user is inadvertently thrown out of board, the sensor 43 sends a signal which causes the three-way valve 43 to open allowing exhaust gases from the engine exhaust pipe to enter the water passage 16.

In an alternative version, a microswitch may be provided connected to detect the rotational position of the grip of the handle bar 25 to send information to the three-way valve 42. When the handle bar grip, held in the operator's hand, is rotated to any cruising position, the microswitch sends a first signal which causes the three-way valve 42 to close the duct 40 to the water passage 16. When the grip is released, as when the operator is mistakenly flung out of board, the microswitch sends a second signal which causes the three-way valve 42 to open so that the water passage 16 will be filled with exhaust gases from the engine exhaust pipe.

Furthermore, with respect to each of the above preferred embodiments, a microswitch may be provided connected to detect the operator's gripping pressure exerted on the handle bar grip to send information to the valve 29 or three-way valve 43. When the grip is properly gripped in the operator's hand during cruising, the microswitch sends a first signal which causes the valve 29 or 43 to close. Should the operator be inadvertently cast out of the deck, the microswitch sends a second signal indicating that the grip is released to the valve 29 or 43, which in turn open the duct 29 or 40.

Alternatively, a microswitch may be provided mounted in the engine in such a manner as to be able to detect the position of the throttle valve in the carburetor to send information to the valve 29 or three-way valve 43. When the throttle valve is open, driven by the operator through the handle bar grip, the microswitch sends a first signal which causes the valve 29 or 43 to close. When the throttle valve is fully closed during operation, as when the operator is inadvertently thrown out of board letting go of the grip, the microswitch sends a second signal which causes the valve 29 or 43 to open the duct 29 or 40.

In the above-mentioned embodiments, descriptions have been made of the various sensors designed to detect the weight of a user on the deck, the position of the grip or the throttle valve, or the operator's gripping pressure on the handle bar grip. However, any suitable means capable of detecting the presence or absence of the user in the deck may be connected to the valve 29 or 43.

It will be clear from the above that the self-halt system according to the present invention can effectively bring a water craft to automatically halt, without stopping the engine, upon the removal of the user's weight from the driver seat in the deck as when he is inadvertently displaced from board. This halt is achieved by permitting atmospheric air or exhaust gases through a properly connected built-in duct into the water passage, so that the engine comes to drive the propeller on air or exhaust gases. Furthermore, the handle-bar grip, upon being released from hold by the user's hand, automatically rotates back by spring force to its home position where the engine is rendered to idling state. Thus, the water craft comes to halt in the water within easy reach of the displaced user who can swim over and recapture the water craft and restart the engine easily to a desired cruising speed.

What is claimed is:

1. A self-halt device for a water-jet power-driven water craft, said water craft comprising an elongate buoyant hollow hull that is defined by a bottom, stern, sidewalls, a deck mounted on top of said hull, an engine-containing compartment defined in said hull, a water passage defined in said bottom, an internal combustion engine mounted in said compartment, said engine comprising a carburetor having a throttle valve, an air inlet and an exhaust line, and an output shaft, a propulsion system comprising a propeller shaft that is operatively connected at one end thereof to said output shaft and a propeller mounted at a rear portion of said bottom and connected to the opposite end of said propeller shaft, said propulsion system being so disposed in said water passage that said propeller rotates to discharge in a jet at said stern water that is introduced into said water passage as the body of said buoyant water craft is sunk into the water by the weight of a user on said deck, a steering system adapted for steering said water craft, said steering system comprising a steering column mounted on said deck and a handle bar rotatably disposed in said steering column for a user to manipulate, a grip rotatably mounted on said handle bar and drivingly connected to said engine in such a manner that manual rotation of said grip controls the speed of said water craft, and a platform mounted on top of said deck and adapted for a user to stand or sit on when operating said water craft, said self-halt device comprising:

sensor means in said water craft, said sensor means being capable of generating a signal in response to the user being thrown off the water craft during cruising;

a duct for conveying gaseous fluids defined in said hull, and extending into said water passage; and a valve installed in said duct and operatively connected to said sensor means, said valve being actuated to move between a first position where said valve closes said duct and, in response to said signal from said sensor, a second position where said valve opens said duct allowing said gaseous fluids to enter said water passage so that said propeller comes to rotate on the introduced said gaseous fluids within said passage, bringing said water craft to an immediate stop.

2. A self-halt device as set forth in claim 1, wherein said sensor means is a sensor system capable of detecting the weight of a user on said platform, said sensor system being activated to generate said signal in response to absence of such weight.

3. A self-halt device as set forth in claim 1, wherein said valve is an electromagnetic valve.

4. A self-halt device as set forth in claim 3, wherein said electromagnetic valve is operated to move between said first and second positions in response to the weight of a user on said platform.

5. A self-halt device as set forth in claim 3, wherein said electromagnetic valve is operated to move between said first and second position in response to the operator's gripping pressure exerted on said grip of said handle bar.

6. A self-halt device for a water-jet power-driven water craft, said water craft comprising an elongate buoyant hollow hull that is defined by a bottom, stern, sidewalls, a deck mounted on top of said hull, an engine-containing compartment defined in said hull, a water passage defined in said bottom, an internal combustion engine mounted in said compartment, said engine comprising a carburetor having a throttle valve, an air inlet and an exhaust line, and an output shaft, a propulsion system comprising a propeller that is operatively connected at one end thereof to said output shaft and a propeller mounted at a rear portion of said bottom and connected to the opposite end of said propeller shaft, said propulsion system being so disposed in said water passage that said propeller rotates to discharge in a jet at said stern water that is introduced into said water passage as the body of said buoyant water craft is sunk into the water by the weight of a user on said deck, a steering system adapted for steering said water craft, said steering system comprising a steering column mounted on said deck and a handle bar rotatably disposed in said steering column for a user to manipulate, a grip rotatably mounted on said handle bar and drivingly connected to said engine in such a manner that manual rotation of said grip controls the speed of said water craft, and a platform mounted on top of said deck and adapted for a user to stand or sit on when operating said water craft, said self-halt device comprising:

sensor means in said water craft, said sensor means being capable of generating a signal in response to the user being thrown off the water craft during cruising;

a duct for conveying gaseous fluids defined in said hull, and extending into said water passage; and a valve installed in said duct and operatively connected to said sensor means, said valve being actuated to move between a first position where said valve closes said duct and, in response to said signal from said sensor, a second position where said valve opens said duct allowing said gaseous fluids to enter said water passage so that said propeller comes to rotate on the introduced gaseous fluids within said passage, bringing said water craft to an immediate stop;

said duct being connected in fluid-flow relationship to said exhaust line and said gaseous fluids being exhaust gases said valve being actuated into said second position in response to said signal establishing fluid-flow communication between said exhaust line and said water passage so that exhaust gases are admitted into said water passage.

7. A self-halt device as set forth in claim 6, wherein said valve is an electromagnetic valve.

8. A self-halt device as set forth in claim 7, wherein said electromagnetic valve is operated to move between said first and second positions in response to the weight of a user on said platform.

9. A self-halt device as set forth in claim 7, wherein said electromagnetic valve is operated to move between said first and second positions in response to the operator's gripping pressure exerted on said grip of said handle bar.

10. A self-halt device for a water-jet power-driven water craft, said water craft comprising an elongate buoyant hollow hull that is defined by a bottom, stern, sidewalls, a deck mounted on top of said hull, an engine-containing compartment defined in said hull, a water passage defined in said bottom, an internal combustion engine mounted in said compartment, said engine comprising a carburetor having a throttle valve, an air inlet and an exhaust line, and an output shaft, a propulsion system comprising a propeller shaft that is operatively connected at one end thereof to said output shaft and a propeller mounted at a rear portion of said bottom and connected to the opposite end of said propeller shaft, said propulsion system being so disposed in said water passage that said propeller rotates to discharge in a jet at said stern water that is introduced into said water passage as the body of said buoyant water craft is sunk into the water by the weight of a user on said deck, a steering system adapted for steering said water craft, said steering system comprising a steering column mountd on said deck and a handle bar rotatably disposed in said steering column for a user to manipulate, a grip rotatably mounted on said handle bar and drivingly connected to said engine in such a manner that manual rotation of said grip controls the speed of said water craft, and a platform mounted on top of said deck and adapted for a user to stand or sit on when operating said water craft, said self-halt device comprising:

sensor means in said water craft, a duct defined in said hull, said duct being formed to open at a first end thereof in said deck into the atmosphere and at a second end thereof into said water passage; and a valve installed in said duct and operatively connected to said sensor means, said valve being actuated to move between a first position where said valve closes said duct and, a second position where said valve opens said duct allowing atmospheric air to enter said water passage so that said propeller comes to rotate on the introduced air within said passage, bringing said water craft to an immediate stop;

said sensor means being a sensor system capable of detecting the weight of a user on said platform, and comprising spring members that are seated in said deck and on which said platform is vertically movably supported to move between an upper and a lower position, said valve being secured to the backside of said platform for vertical movement therewith and vertically movably disposed in said duct to shift between said first and second positions, the combined force of said spring members being so selected that the weight of the user causes said platform to move down into said lower position against the spring members bringing said valve into said first position whereas the absence of such weight allows said platform to hold way above said deck in said upper position holding said valve in said second position.

11. A self-halt device for a water-jet power-driven water craft, said water craft comprising an elongate buoyant hollow hull that is defined by a bottom, stern, and sidewalls, a deck mounted on top of said hull, an engine compartment defined in said hull, a water passage defined in said bottom, an engine mounted in said engine compartment, said engine comprising an air inlet and an exhaust line, and an output shaft, a propulsion system comprising a propeller shaft operatively connected at one end thereof to said output shaft and a propeller mounted at a rear portion of said bottom and connected to the opposite end of said propeller shaft, said propulsion system being so disposed in said water passage that said propeller rotates to discharge at said stern in a jet water that is introduced into said water passage, a steering system for steering said water craft, and a platform mounted on top of said deck and adapted for a user to stand or sit on when operating said water craft, said self-halt device comprising:

sensor means mounted in said water craft, said sensor means being capable of generating a signal in response to the user being thrown off the water craft during the cruising;

a duct for conveying gaseous fluids defined in said hull, and extending into said water passage; and a valve installed in said duct and operatively connected to said sensor means, said valve being actuated to move between a first position wherein said valve closes said duct and, in response to said signal from said sensor, a second position wherein said valve opens said duct allowing said gaseous fluid to enter said water passage so that said propeller rotates on the introduced said gaseous fluids within said passage, bringing said water craft to an immediate stop.

12. A self-halt device for a water-jet power-driven water craft, said water craft comprising an elongate buoyant hollow hull that is defined by a bottom, stern, and sidewalls, a deck mounted on top of said hull, an engine compartment defined in said hull, a water passage defined in said bottom, an engine mounted in said engine compartment, said engine comprising an air inlet and an exhaust line, and an output shaft, a propulsion system comprising a propeller shaft operatively connected at one end thereof to said output shaft and a propeller mounted at a rear portion of said bottom and connected to the opposite end of said propeller shaft, said propulsion system being so disposed in said water passage that said propeller rotates to discharge at said stern in a jet water that is introduced into said water passage, a steering system for steering said water craft, and a platform mounted on top of said deck and adapted for a user to stand or sit on when operating said water craft, said self-halt device comprising:

sensor means mounted in said water craft;

a duct defined in said hull, said duct being formed to open at a first end thereof in said deck into the atmosphere and at a second end into said water passage; and a valve installed in said duct and operatively connected to said sensor means, said valve being actuated to move between a first position wherein said valve closes said duct and, a second position wherein said valve opens said duct allowing atmospheric air to enter said water passage so that said propeller rotates on the introduced air within said passage, bringing said water craft to an immediate stop;

said sensor means comprising a plurality of coil springs seated in fixed positions in said deck, said platform being vertically movably disposed on said coil springs, said valve being secured to a backside of said platform, the combined spring force of said coil springs being so pre-determined that the body weight of a user on said platform causes said platform to come down overcoming said combined spring force thereby causing said valve to move into said first position whereas said platform is held up by said coil springs in the absence of a user's body weight on said platform.

* * * * *